US005729084A

United States Patent [19]

Hale et al.

[11] Patent Number: 5,729,084

[45] Date of Patent: Mar. 17, 1998

[54] THERMIONIC CATHODE WITH CONTINUOUS BIMETALLIC WALL

[75] Inventors: John Richard Hale, Lancaster; Jeffrey M. Farina, Zionsville; Philip J. Koehler, St. Davids; Nicholas Maropis, Baden, all of Pa.

[73] Assignee: UTI Corporation, Collegeville, Pa.

[21] Appl. No.: 2,286

[22] Filed: Jan. 8, 1993

[51] Int. Cl.[6] ..... H01J 29/46

[52] U.S. Cl. ..... 313/446; 313/270

[58] Field of Search ..... 313/446, 451, 313/457, 270, 332; 445/36

[56] References Cited

U.S. PATENT DOCUMENTS

| | | | |
|---|---|---|---|
| 2,663,069 | 12/1953 | Espersen | 29/25.14 |
| 3,214,626 | 10/1965 | Larson | 313/270 |
| 3,432,900 | 3/1969 | Kerstetter | 29/25.17 |
| 3,974,414 | 8/1976 | Buescher et al. | 313/337 |
| 4,092,560 | 5/1978 | Puskas | 313/244 |
| 4,514,660 | 4/1985 | Opresko | 313/446 |
| 4,554,479 | 11/1985 | Opresko | 313/417 |
| 4,558,254 | 12/1985 | Opresko | 313/446 |
| 4,803,397 | 2/1989 | Heynisch et al. | 313/337 |
| 5,013,965 | 5/1991 | Shon et al. | 313/446 |
| 5,218,263 | 6/1993 | Falce et al. | 313/270 |
| 5,422,536 | 6/1995 | Hale et al. | 313/270 |

*Primary Examiner*—Sandra L. O'Shea
*Assistant Examiner*—Vip Patel
*Attorney, Agent, or Firm*—Seidel, Gonda, Lavorgna & Monaco, PC

[57] ABSTRACT

A cathode sheath for a thermionic electron-gun cathode. The sheath is substantially in the form of a hollow cylinder and has an outer surface and an inner surface, a central axis, a closed end and an axially-opposite open end, and a side wall extending between the closed end and the open end. The sheath is a continuous bimetallic laminate having a first layer of material forming the inner surface and a second layer of electron-emissive material overlying substantially the entirety of the first layer and forming the outer surface. The laminate has a preselected thickness at the closed end and has a thickness at the side wall which varies along the central axis.

20 Claims, 4 Drawing Sheets

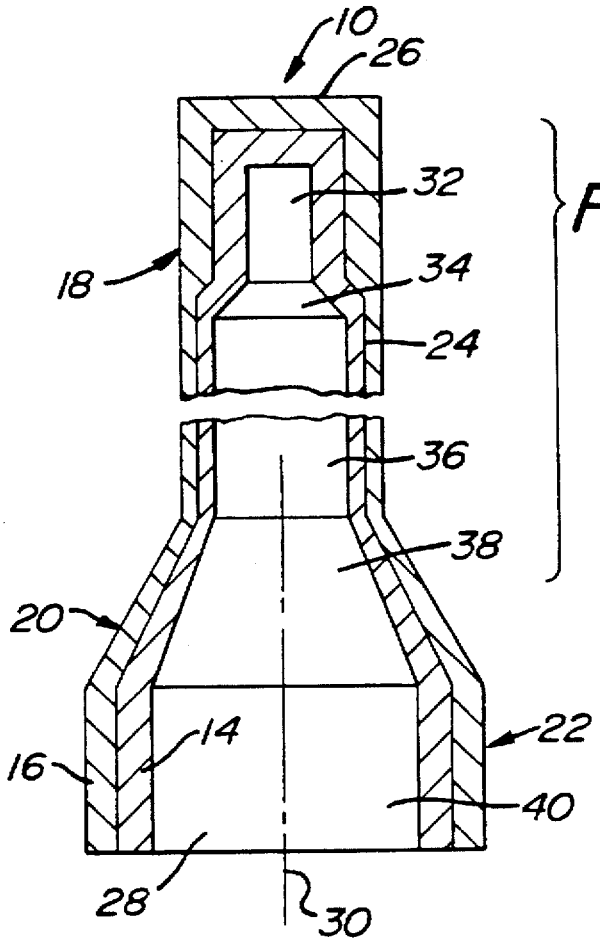
FIG. 3
FIG. 4
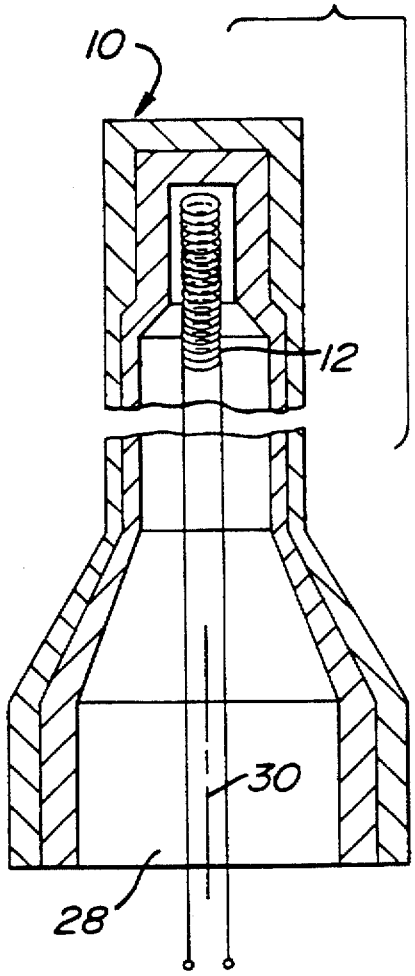
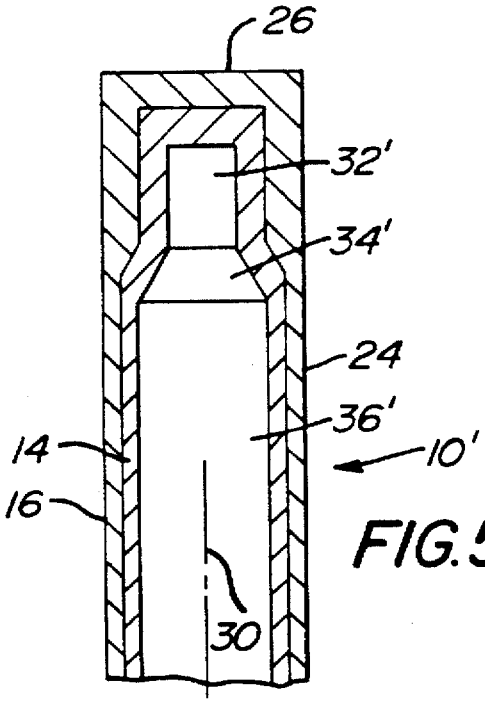
FIG. 5

FIG.8
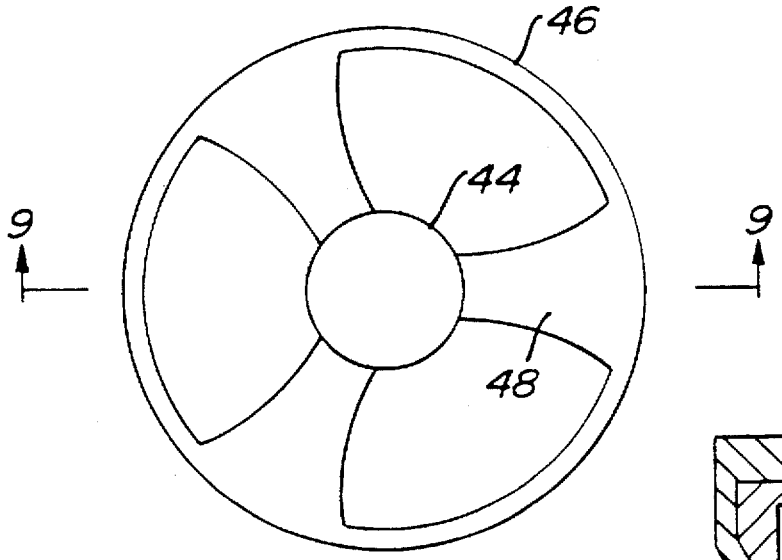
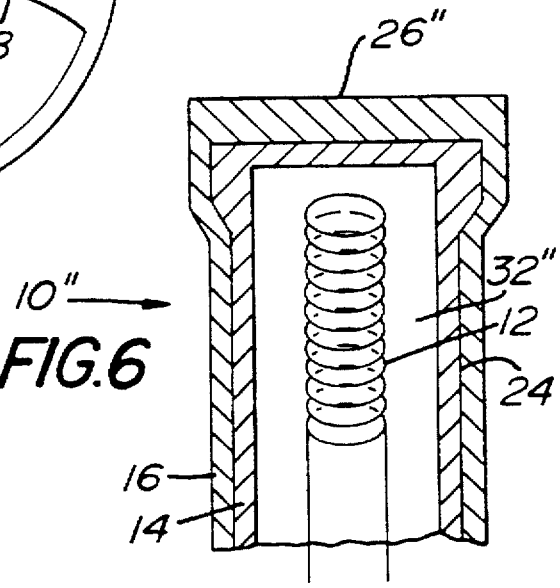
FIG.6
FIG.9
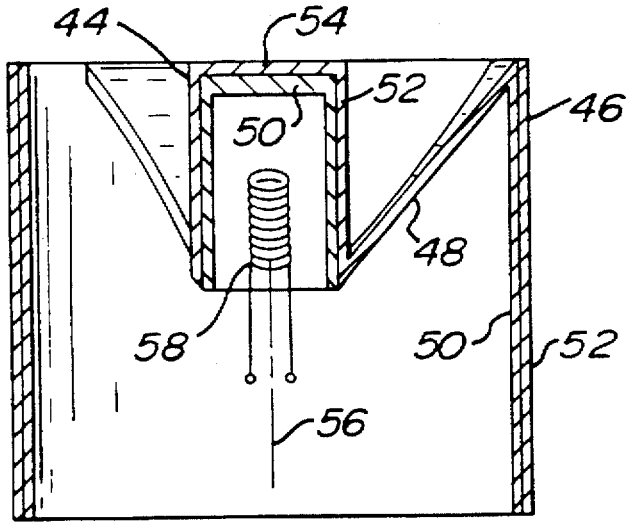

G2
G1
10
12
10
12
10
12
42
40

THERMIONIC CATHODE WITH CONTINUOUS BIMETALLIC WALL

FIELD OF THE INVENTION

The present invention relates to thermionic cathodes for cathode ray tubes and the like.

BACKGROUND OF THE INVENTION

A cathode ray tube is an electron tube in which a beam of electrons is focused to a small area and varied in position and intensity on a surface. The surface referred to is cathodoluminescent, that is, luminescent under electron bombardment. In such tubes, the output information is presented in the form of a pattern of light which can be perceived by the eye. The character of the pattern is related to, and controlled by, one or more electrical signals applied to the cathode ray tube as input information.

The most familiar form of the cathode ray tube is the television picture tube, found in home television receivers. Cathode ray tubes are also used in measuring instruments such as oscilloscopes, which have been indispensable in laboratories devoted to experimental studies in science and engineering. For navigation, the cathode ray tube is the output device of radars. Increasingly, cathode ray tubes are finding use in input/output terminals of digital computers. Cathode ray tubes can display information quickly, using formats that are much less restrictive than other output devices such as printers. Cathode ray tubes are put to numerous other uses in science, industry and the arts.

The basic elements of a cathode ray tube are the envelope, electron gun and phosphor screen. While all of these elements are well known in the art, and do not need to be described in detail, a brief description of the electron gun is helpful in understanding the context of the present invention.

The electron gun produces, controls, focuses and deflects an electron beam. The electron gun consists of an electrical element called a heater, a thermionic cathode, and an assemblage of cylinders, caps and apertures which are all held in the proper orientation by devices such as glass beads, ceramic rods and spacers. The thermionic cathode is the source of the electrons in the electron beam. The emitting material is generally a barium-calcium-strontium oxide coating deposited on the end of a deep-drawn nickel cup with cylindrical walls. The oxide coating emits electrons when heated. The walls of the cup enclose a coiled tungsten wire coated with a refractory insulating material such as aluminum oxide. The passage of current through this wire generates sufficient heat, transmitted by conduction and radiation to the cup, to maintain the oxide coating at emitting temperatures on the order of 1100° K. The heater-cathode structure is supported coaxially within, and insulated from, a control grid. The control grid along with other elements of the electron gun controls the intensity and direction of the beam.

A common technique for fabricating thermionic cathodes is to deep-draw the cathode sleeve from a bimetallic laminate. The resulting cathode sleeve comprises a laminated bimetallic member having a first layer and a second layer. The laminated bimetal layers are shown in FIG. 1, which illustrates a prior art cathode sleeve formed by a deep-drawing process. The first, or inner, layer typically comprises Nichrome. The second, or outer, layer typically comprises electronic grade nickel. The deep-drawn cathode sleeve is then selectively etched in a mixture of acids to remove the outer layer of nickel from all portions of the cathode sleeve except at the closed end, as shown in FIG. 2. The etching process restricts the nickel layer to an end cap, and exposes the Nichrome layer which has a lower thermal conductivity than the nickel layer. As those skilled in the art will understand, it is desirable to lower the thermal conductivity of the cathode sleeve to concentrate the heat at the closed end. This minimizes heat losses which increase the time required for heating up the cathode material to the operating temperature through the heat energy supplied by the heater. It is, of course, possible to minimize heating time by increasing the amount of current supplied to the heater, but this increases power consumption and is generally considered to be undesirable. In addition, minimizing heat losses also maintains the transmission efficiency of heat from the heater to the cathode, to obtain a desired thermal electron emission from the cathode. Removing the nickel layer from all portions of the cathode except the end cap has been a typical solution to the problem.

Clearly, etching with acids presents numerous disadvantages. Moreover, the etching process must be precisely controlled, since typically the cathode parts are quite small (on the order of less than 0.350 inch in length and only about 0.075 inch in diameter, and on the order of 0.025 grams on mass). Small variations in the etching process can produce unacceptably wide variations in the finished parts, or even render the finished parts useless.

The present invention eliminates the need for acid etching and other finishing steps subsequent to deep-drawing without sacrificing the desired thermal characteristics of the cathode.

SUMMARY OF THE INVENTION

The present invention is directed to a cathode sheath for a thermionic electron-gun cathode. The sheath is substantially in the form of a hollow cylinder having an outer surface and an inner surface, a central axis, a closed end and an axially-opposite open end, and a side wall extending between the closed end and the open end. The sheath comprises a continuous bimetallic laminate having a first layer of material forming the inner surface and a second layer of electron-emissive material overlying substantially the entirety of the first layer and forming the outer surface. The laminate has a preselected thickness at the closed end and a thickness at the side wall which varies along the central axis.

DESCRIPTION OF THE DRAWINGS

For the purpose of illustrating the invention, there is shown in the drawings a form which is presently preferred; it being understood, however, that this invention is not limited to the precise arrangements and instrumentalities shown.

FIGS. 3 and 4 illustrate a cathode sheath according to one embodiment of the present invention.

FIG. 5 illustrates a cathode sheath according to a second embodiment of the present invention.

FIG. 6 illustrates a cathode sheath according to a third embodiment of the present invention.

FIG. 8 shows a cathode sheath according to a third embodiment of the present invention.

FIG. 9 is a sectional view of the cathode sheath shown in FIG. 8, taken along the lines 9—9 in FIG. 8.

DESCRIPTION OF THE INVENTION

Figure 1:
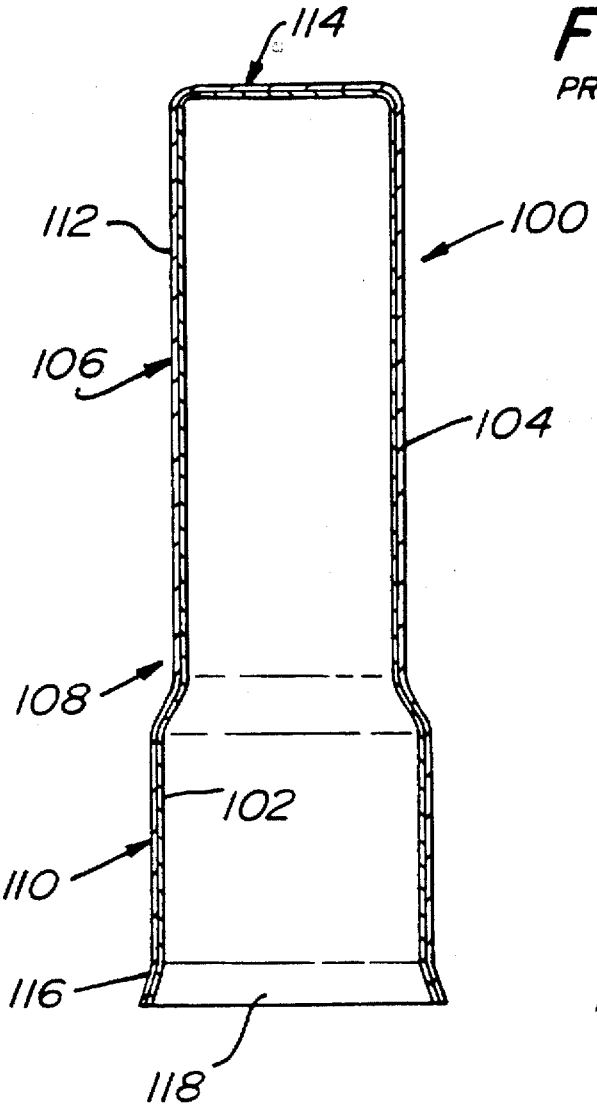
FIG. 1 PRIOR ART
FIGS. 1 and 2 illustrate a cathode sheath according to the prior art.
Figure 2:
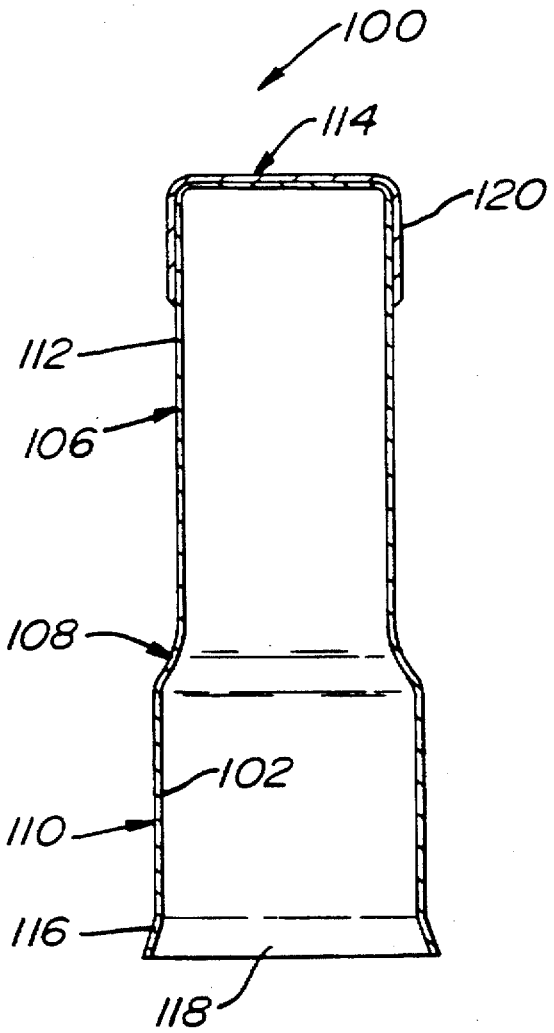
FIG. 2 PRIOR ART

Referring to the drawings, wherein like elements are indicated with like numerals, there is shown in FIGS. 1 and 2 a cathode sheath 100 according to the prior art. Cathode sheath 100 is formed by deep drawing, and comprises a bimetallic laminate having a first layer 102 and a second layer 104. First layer 102 is typically Nichrome, and second layer 104 typically comprises nickel.

Cathode sheath 100 includes three longitudinally-extending portions 106, 108 and 110, respectively. The first portion 106 forms a cylindrical side wall 112 and a closed end 114. Side wall 112 extends from closed end 114 for a predetermined distance, typically about 0.230 inch. A transition portion 108 connects portion 106 to portion 110, which has a slightly greater diameter than portion 106. Portion 110 terminates in a flare 116 surrounding open end 118 of the cathode sheath 100. A heater filament (not shown) is placed inside cathode sheath 100 to heat the cathode sheath to a suitable temperature at which the second layer will emit electrons.

It will be observed from FIG. 1 that, after cathode sheath 100 has been formed, the laminate composed of the first and second layers is of substantially constant thickness throughout the part. Thus, prior to any etching operation, the thickness of the laminate does not vary between the closed end 114 and the open end 118 of cathode sheath 100.

Nichrome, which comprises first layer 102, has a thermal conductivity of about 0.195 W/cm/°K at 700° K, while the thermal conductivity of nickel, which comprises second layer 104, is much higher, about 0.65 W/cm/°K at the same temperature. To lower the thermal conductivity of the cathode sheath in order to concentrate heat from the heater filament at the closed end 114, a portion of the nickel second layer is selectively removed by etching the cathode sheath 100 in a mixture of acids. The etching exposes the Nichrome second layer and leaves behind a nickel end cap 120 at closed end 114. The removal of the high thermal conductivity nickel second layer 104 from the Nichrome first layer 102 reduces heat conduction along the cathode sheath 100 from the closed end 114 to the open end 118, which has the natural result of concentrating the heat from the heater filament at the closed end 114.

The present invention makes it possible to eliminate the acid etching step while at the same time retaining the desired reduced heat conduction along the cathode sheath. Referring now to FIGS. 3 and 4, there is shown a cathode sheath 10 in accordance with one embodiment of the present invention. FIGS. 3 and 4 are the same, except that FIG. 4 shows the location of a heating filament 12 located inside the cathode sheath 10. Heating filament 12 is conventional and need not be described in detail, since it does not form part of the present invention. FIG. 4 is included simply to show the relationship of the cathode sheath 10 of the present invention and a conventional heater filament. Cathode sheath 10 is formed by deep drawing, and comprises a bimetallic laminate having a first, or inner, layer 14 and a second, or outer, layer 16. First layer 14 may typically be Nichrome, and second layer 16 comprises an electron emissive material such as, for example, nickel.

Cathode sheath 10 includes three longitudinally-extending portions 18, 20 and 22, respectively. The first portion 18 forms a cylindrical side wall 24 and a closed end 26. Side wall 24 extends from closed end 26 for a predetermined distance, typically about 0.250 inch. The outer diameter of portion 18 is on the order of about 0.100 inch. A transition portion 20 connects portion 18 to portion 22, which has a slightly greater outer diameter than portion 18, typically about 0.115 inch. Portion 22 terminates in an open end 28. Portion 22 may if desired, terminate in a flare (not shown), such as flare 116 surrounding open end 118 of the cathode sheath 100.

Alternatively, the outer diameter of the cathode sheath may be constant all along the axis, as with cathode sheath 10' of the alternate embodiment of the invention illustrated in FIG. 5. As with the embodiment shown in FIGS. 3 and 4, cathode sheath 10' shown in FIG. 5 comprises a continuous bimetallic laminate having a first, or inner, layer 14 (typically Nichrome) and a second, or outer, layer 16, comprising an electron emissive material.

It will be observed that outer layer 16 overlies substantially the entirety of first layer 14. Thus, substantially no part of the outer layer 16 is intentionally removed and there is no end cap such as end cap 120 in the prior art cathode sheath shown in FIGS. 1 and 2. Consequently, no acid etch or other operation to remove selected portions of outer layer 16 is employed.

Moreover, the laminate composed of layers 14 and 16 is not of uniform thickness throughout cathode sheath 10 or cathode sheath 10'. Instead, the thickness of the laminate varies along the central axis 30 of the cathode sheath. Preferably, the thickness of the laminate is greatest near closed end 26, and decreases along the central axis 30 in a direction away from closed in 26. This defines a first interior region 32 having a first interior diameter. Typically, but not necessarily, the thickness of the laminate at closed end 26 is between about 0.003 and 0.004 inch. For a typical outer diameter of longitudinally extending portion 18 of about 0.100 inch, the first interior diameter will be about 0.092 inch. First interior region extends along central axis 30 in a direction away from closed end 26 for a distance of between about 0.040 and 0.050 inch, where the interior diameter increases in first interior transition region 34 to a second interior region 36 of larger interior diameter. The outer diameter of the cathode sheath is the same, however, at both the first interior region and the second interior region. The thickness of the laminate at second interior region 36, therefore, is less than the thickness of the laminate at the first interior region, and is on the order of about 0.001 inch. This, of course, results in an interior diameter for the second interior region of about 0.098 inch. In this region, the thickness of first layer 14 is about 0.00065 inch, and the thickness of second layer 16 is about 0.00035 inch.

Second interior region 36 opens into a second interior transition region 38, in which the interior diameter of cathode sheath 10 increases. It can be seen from FIG. 3 that second interior transition region 38 is substantially coextensive with exterior transition portion 20. Second interior transition region 38 finally opens into a third interior region 40 at open end 28. In this area, the thickness of the laminate is about 0.0034, with first layer 14 being about 0.0022 inch and second layer being about 0.0012 inch. The thicknesses of layers 14 and 16 can increase relatively uniformly from second interior region 38 to third interior region 40.

As already noted in connection with the embodiment illustrates in FIG. 5, the outer diameter of the cathode sheath 10' may be substantially constant. In that case, there will be no transition portion such as transition portion 20 shown in FIG. 3. However, there is still provided a first interior region 32', an interior transition region 34' and a second interior region 36' of larger interior diameter than first interior region 34'. As with the embodiment illustrated in FIG. 3, the thickness of the laminate at closed end 26 is between about 0.003 and 0.004 inch. For a typical outer diameter of about 0.100 inch, the first interior diameter will be about 0.092 inch. First interior region 32' extends along central axis 30 in a direction away from closed end 26 for a distance of between about 0.040 and 0.050 inch, where the interior diameter increases in interior transition region 34' to a second interior region 36' of larger interior diameter. Since the outer diameter of the cathode 10' sheath is constant, however, the thickness of the laminate at second interior region 36' is therefore less than the thickness of the laminate at the first interior region 32', and is on the order of about 0.001 inch. This, of course, results in an interior diameter for the second interior region 36' of about 0.098 inch. In this region, the thickness of first layer 14 is about 0.00065 inch, and the thickness of second layer 16 is about 0.00035 inch.

A third embodiment of the invention, indicated by reference numeral 10", is illustrated in FIG. 6. In this third embodiment, interior region 32" is of constant inner diameter, and closed end 26 has an outer diameter greater than the outer diameter of the remainder of cathode sheath 10". This provides a bulbous closed end 26". As with the previously-illustrated embodiments, the thickness of the laminate at the closed end 26" is between about 0.003 and 0.004 inch. For a typical outer diameter of cathode sheath 10" of about 0.100 inch, the outer diameter of the closed end 26" will be between about 0.106 and 0.108 inch. The thickness of the laminate in the remainder of cathode sheath is about 0.001 inch, as in the previously-described embodiments. Thus, the inner diameter is about 0.098 inch.

In all embodiments, the thickness of the first and second layers, and consequently the thickness of the bimetallic laminate, is determined during the deep drawing process. Hence, upon completion of the deep drawing process, the cathode sheath is essentially complete, and no further major manufacturing operations such as acid etching, machining or the like, are required.

As those skilled in the art will appreciate, reducing the thickness of the outer nickel layer (without removing it as in the prior art) lowers the thermal conductivity of the cathode sheath to concentrate the heat from filament heater 12 at the closed end. As a result, thermal losses for the cathode sheath according to the invention are comparable to conventional prior art cathodes in which the highly thermally-conductive electron-emissive outer layer is etched away except at the closed end of the cathode sheath. Consequently, performance parameters such as warm-up time, filament power consumption, thermal stability and the like are all comparable to prior art etched electrodes, but without requiring the etching step.

Figure 7:
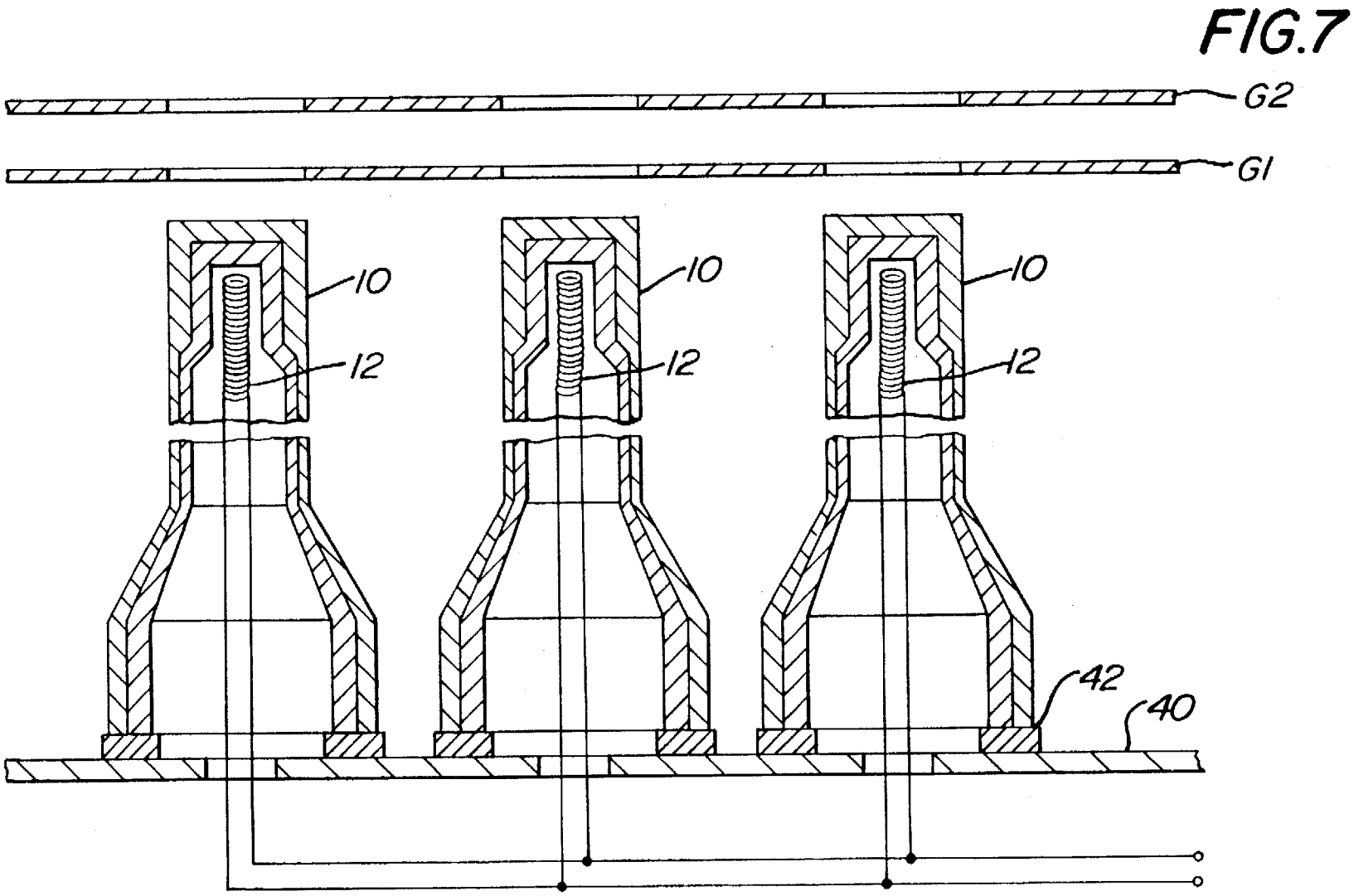
FIG. 7 illustrates a typical three-beam electron gun incorporating the cathode sheath shown in FIGS. 3 and 4.

As illustrated in FIG. 7, cathode sheaths 10 (or cathode sheaths 10') are directly usable in conventional electron gun assemblies. For example, the electron gun may be a three-beam gun for color television picture tubes. In that case, three cathode sheaths, one for each beam, are employed. The cathode sheaths 10 are mounted on a suitable substrate 40 via a ring 42. Each cathode sheath 10 is heated by its own filament heater 12. Electrons emitted by the outer electron-emissive nickel layer 16 are accelerated by magnetic yokes (not shown) in known manner, and deflected (also in known manner) by a plurality of control grids, such as grids G1 and G2 shown in FIG. 7. The way in which the cathode sheaths according to the present invention may be used will be readily apparent to those skilled in the art, and need not be described in further detail.

Thermal conductivity from the closed end of the cathode sheath of the invention may be reduced still further by supporting the cathode sheath within a cylindrical eyelet by means of a spider, such as shown in FIGS. 8 and 9. In the embodiment of the invention illustrated in FIGS. 8 and 9, cathode sheath 44 is supported axially in a generally cylindrical eyelet 46 by means of a spider 48 having a plurality of legs. Preferably, cathode sheath 44, eyelet 46 and spider 48 are formed integrally from a single bimetallic laminate comprising an inner layer 50 and an outer layer 52. As with the embodiments described previously, inner layer 50 is preferably Nichrome, and outer layer is an electron-emissive material such as electronic grade nickel. Also as with the previously-described embodiments, the laminate is continuous and none of the outer nickel layer is etched away. Thermal conductivity from the closed end 54 is reduced by reducing the thickness of the laminate at the side wall of cathode sheath 44 along central axis 56, and by mounting cathode sheath 44 on spider 48, which reduces the amount of laminate material between cathode sheath 44 and eyelet 46. Thus, the heat from filament heater 56 is concentrated at closed end 54 of cathode sheath 44.

In this embodiment, the thickness of the bimetallic laminate composed of layers 50 and 52 need not vary with the axial dimension of the cathode sheath 44 but may, as shown in FIG. 9, be constant along the axis of cathode sheath 44. Because of the insignificant mass of cathode sheath 44 when used with a spider 48 and eyelet 46 to support the cathode sheath, it may not be necessary to vary the thickness of the cathode side walls.

The manufacturing operations by which the cathode sheaths according to the present invention are made are not described here in detail, since deep drawing operations are well known to those skilled in the art, and since the particular manufacturing steps employed may be varied without departing from the scope of the present invention.

The present invention may be embodied in other specific forms without departing from the spirit or essential attributes thereof and, accordingly, reference should be made to the appended claims, rather than to the foregoing specification, as indicating the scope of the invention.

We claim:

1. A cathode sheath for a thermionic electron-gun cathode, the sheath being substantially in the form of a hollow cylinder having an outer surface and an inner surface, a central axis, a closed end and an axially-opposite open end, and a side wall extending between the closed end and the open end, the sheath comprising a continuous bimetallic laminate having a first layer of material forming the inner surface and a second layer of electron-emissive material overlying substantially the entirety of the first layer and forming the outer surface, the laminate having a preselected thickness at the closed end and having a thickness at the side wall which varies along the central axis.

2. A cathode sheath according to claim 1, wherein the hollow cylinder has an outer diameter which is constant.

3. A cathode sheath according to claim 1, wherein the hollow cylinder has an outer diameter which varies from the closed end to the open end.

4. A cathode sheath according to claim 3, wherein the outer diameter at the open end is greater than the outer diameter at the closed end.

5. A cathode sheath according to claim 1, wherein the hollow cylinder has an outer diameter which is constant and an inner diameter which varies along the central axis from the closed end to the open end.

6. A cathode sheath according to claim 5, wherein the inner diameter at the open end is greater than the inner diameter at the closed end.

7. A cathode sheath according to claim 1, wherein the thickness of the laminate at the closed end and the thickness of the laminate at the side wall are substantially the same for a portion of the side wall adjacent the closed end.

8. A cathode sheath according to claim 1, wherein the thickness of the laminate at the side wall adjacent the closed end is greater than the thickness of the laminate at the side wall adjacent the open end.

9. A cathode sheath according to claim 7, wherein the thickness of the laminate at the closed end and at the side wall adjacent the closed end is greater than the thickness of the laminate at the side wall adjacent the open end.

10. A cathode sheath according to claim 1, further comprising eyelet means substantially surrounding the cathode sheath side wall and spider means for supporting the cathode sheath in the eyelet means.

11. A cathode sheath according to claim 10, wherein the cathode sheath, eyelet means and spider means comprise a one-piece structure.

12. A cathode sheath according to claim 11, wherein the cathode sheath, eyelet means and spider means comprise the continuous bimetallic laminate.

13. An electron gun for a cathode ray tube, comprising a cathode sheath substantially in the form of a hollow cylinder having an outer surface and an inner surface, a central axis, a closed end and an axially-opposite open end, and a side wall extending between the closed end and the open end, the sheath comprising a continuous bimetallic laminate having a first layer of material forming the inner surface and a second layer of electron-emissive material overlying substantially the entirety of the first layer and forming the outer surface, the laminate having a preselected thickness at the closed end and having a thickness at the side wall which varies along the central axis, and a heater filament disposed axially within the hollow cylinder adjacent the closed end for heating the cathode sheath to a preselected temperature.

14. A cathode ray tube comprising a cathodoluminescent screen, an electron gun having a cathode sheath substantially in the form of a hollow cylinder having an outer surface and an inner surface, a central axis, a closed end and an axially-opposite open end, and a side wall extending between the closed end and the open end, the sheath comprising a continuous bimetallic laminate having a first layer of material forming the inner surface and a second layer of electron-emissive material overlying substantially the entirety of the first layer and forming the outer surface, the laminate having a preselected thickness at the closed end and having a thickness at the side wall which varies along the central axis, a heater filament disposed axially within the hollow cylinder adjacent the closed end for heating the cathode sheath to a preselected temperature, and means for accelerating and directing electrons emitted by the first layer toward the cathodoluminescent screen.

15. A method of making a thermionic cathode from a bimetallic laminate having a preselected thickness, comprising the steps of forming a substantially cylindrical cathode sheath having a closed end and an open end and a side wall which extends between the open end and the closed end, mechanically progressively reducing the thickness of the laminate along the side wall in a direction from the closed end to toward the open end substantially without removing any material from the bimetallic laminate to define a first region adjacent the closed end wherein the laminate thickness is substantially equal to the preselected thickness and at least a second region between the first region and the open end wherein the laminate thickness is less than the preselected thickness.

16. A cathode for a thermionic electron-gun cathode, comprising a cathode sheath being substantially in the form of a hollow cylinder having an outer surface and an inner surface, a central axis, a closed end and an axially-opposite open end, and a side wall extending between the closed end and the open end, the sheath comprising a continuous bimetallic laminate having a first layer of material forming the inner surface and a second layer of electron-emissive material overlying substantially the entirety of the first layer and forming the outer surface, the laminate having a preselected thickness, eyelet means substantially surrounding the cathode sheath side wall and spider means for supporting the cathode sheath in the eyelet means.

17. A cathode sheath according to claim 16, wherein the hollow cylinder has an outer diameter which is constant.

18. A cathode sheath according to claim 16, wherein the thickness of the laminate at the closed end and the thickness of the laminate at the side wall are substantially the same.

19. A cathode sheath according to claim 16, wherein the cathode sheath, eyelet means and spider means comprise a one-piece structure.

20. A cathode sheath according to claim 19, wherein the cathode sheath, eyelet means and spider means comprise the continuous bimetallic laminate.

* * * * *